US006908358B2

(12) United States Patent
Lin

(10) Patent No.: US 6,908,358 B2
(45) Date of Patent: Jun. 21, 2005

(54) THIN-LAYER BUBBLE BLOWER

(76) Inventor: Mon-Sheng Lin, 5th Floor, No. 4, Lane 7, Pao Kao Road, Hsintien, Taipei Hsien (TW)

( * ) Notice: Subject to any disclaimer, the term of this patent is extended or adjusted under 35 U.S.C. 154(b) by 0 days.

(21) Appl. No.: 10/660,511

(22) Filed: Sep. 12, 2003

(65) Prior Publication Data

US 2005/0059314 A1 Mar. 17, 2005

(51) Int. Cl.[7] ..... A63H 33/28
(52) U.S. Cl. ..... 446/16; 446/15
(58) Field of Search ..... 446/15, 16, 17, 446/18, 19, 20, 21

(56) References Cited

U.S. PATENT DOCUMENTS 5,653,620 A * 8/1997 Lin ..... 446/15
6,132,125 A * 10/2000 Lin ..... 401/195
6,386,935 B1 * 5/2002 Lin ..... 446/16
6,443,791 B1 * 9/2002 Portwine ..... 446/15
6,524,155 B1 * 2/2003 Lin ..... 446/16
6,620,017 B1 * 9/2003 Bitton ..... 446/16

* cited by examiner

*Primary Examiner*—Daniel W. Howell
*Assistant Examiner*—Ali Abdelwahed
(74) *Attorney, Agent, or Firm*—Troxell Law Office, PLLC

(57) ABSTRACT

A thin-layer bubble blower includes a thin-layer container of thickness within 2–6 mm, the thin-layer container defining a flat liquid chamber for holding a bubble solution and an opening in communication with the flat liquid chamber, and a bubble-blowing bar for blowing the bubble solution into bubbles, the bubble-blowing bar having a rubber stopper, which seals the opening of the thin-layer container after insertion of the bubble-blowing bar into the flat liquid chamber.

3 Claims, 18 Drawing Sheets

THIN-LAYER BUBBLE BLOWER

BACKGROUND OF THE INVENTION

1. Field of the Invention

The present invention relates to bubble blowers and, more particularly, to a thin-layer bubble blower, which has a thin-layer container of thickness within 2~6 mm for holding a bubble solution.

2. Description of the Related Art

Conventional bubble blowers are commonly comprised of a container for holding a bubble solution, and a bubble-blowing bar for blowing the bubble solution into bubbles. The containers of conventional bubble blowers may be made having any of a variety of shapes to attract children. However, these containers are commonly have a cylindrical shape of diameter greater than 10 mm. Due to space occupation, these containers cannot be used or matched with other articles or ornamental devices to add the value.

SUMMARY OF THE INVENTION

The present invention has been accomplished under the circumstances in view. It is the main object of the present invention to provide a thin-layer bubble blower, which has a thin-layer container of thickness within 2~6 mm for holding a bubble solution. According to the present invention, the thin-layer bubble blower comprises a thin-layer container of thickness within 2~6 mm, the thin-layer container defining a flat liquid chamber for holding a bubble solution and an opening in communication with the flat liquid chamber, and a bubble-blowing bar for blowing said bubble solution into bubbles, the bubble-blowing bar having a rubber stopper, which seals the opening of the thin-layer container after insertion of the bubble-blowing bar into the flat liquid chamber. The thin-layer container may be provided with an open frame for holding a picture or card, or attached with an ornament. A labyrinth may be formed in the thin-layer container, which is made transparent.

DETAILED DESCRIPTION OF THE PREFERRED EMBODIMENT

Figure 4:
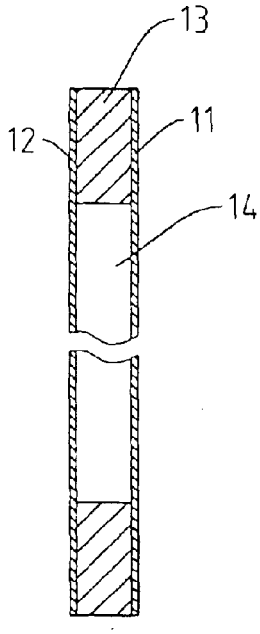
FIG. 4 is a sectional view showing one example of the arrangement between the male and female coupling means and the flat cover plates for the thin-layer container according to the present invention.
Figure 5:
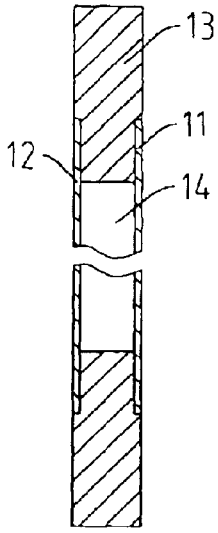
FIG. 5 is a sectional view showing another example of the arrangement between the male and female coupling means and the flat cover plates for the thin-layer container according to the present invention.

Referring to FIGS. 1~7, a thin-layer bubble blower in accordance with the present invention is shown comprised of a thin-layer container 1, and a flat bubble-blowing bar 2. Preferably, the thin-layer container 1 has a thickness about 2~6 mm. The thin-layer container 1 is comprised of two flat cover plates 11 and 12, and male and female coupling means 13 respectively extended around the border of the flat cover plates 11 and 12 for joining the flat cover plates 11 and 12. When assembled, the thin-layer container 1 defines a flat liquid chamber 14 and an opening 15 disposed at the periphery in communication with the flat liquid chamber 14 through which the bubble-blowing bar 2 is inserted into the flat liquid chamber 14 to pick up bubble solution contained in the flat liquid chamber 14. The FIGS. 4 and 5 show two different arrangements of the male and female coupling means 13 between flat cover plates 11 and 12.

Figure 1:
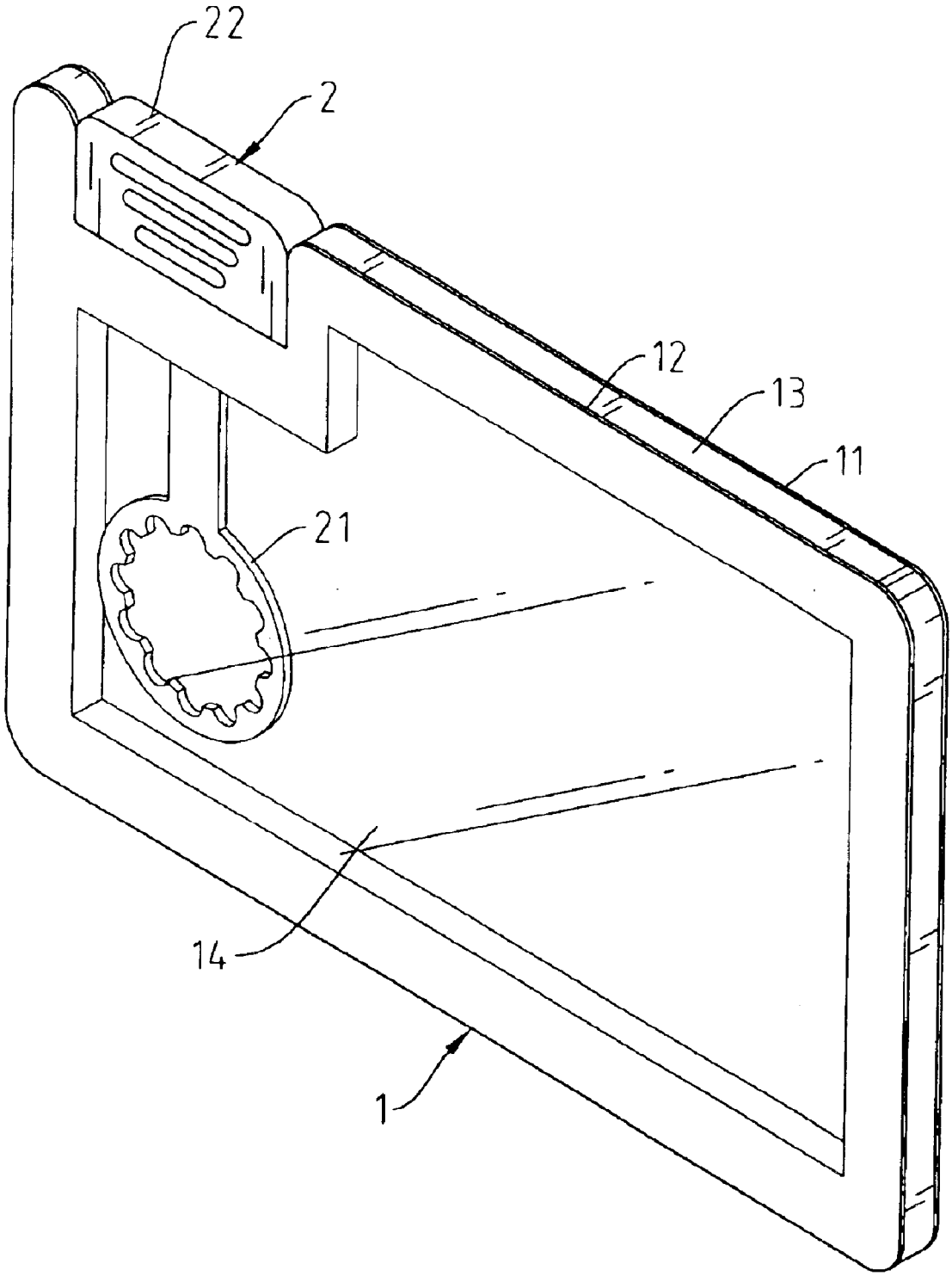
FIG. 1 illustrates a thin-layer bubble blower constructed according to the present invention.
Figure 2:
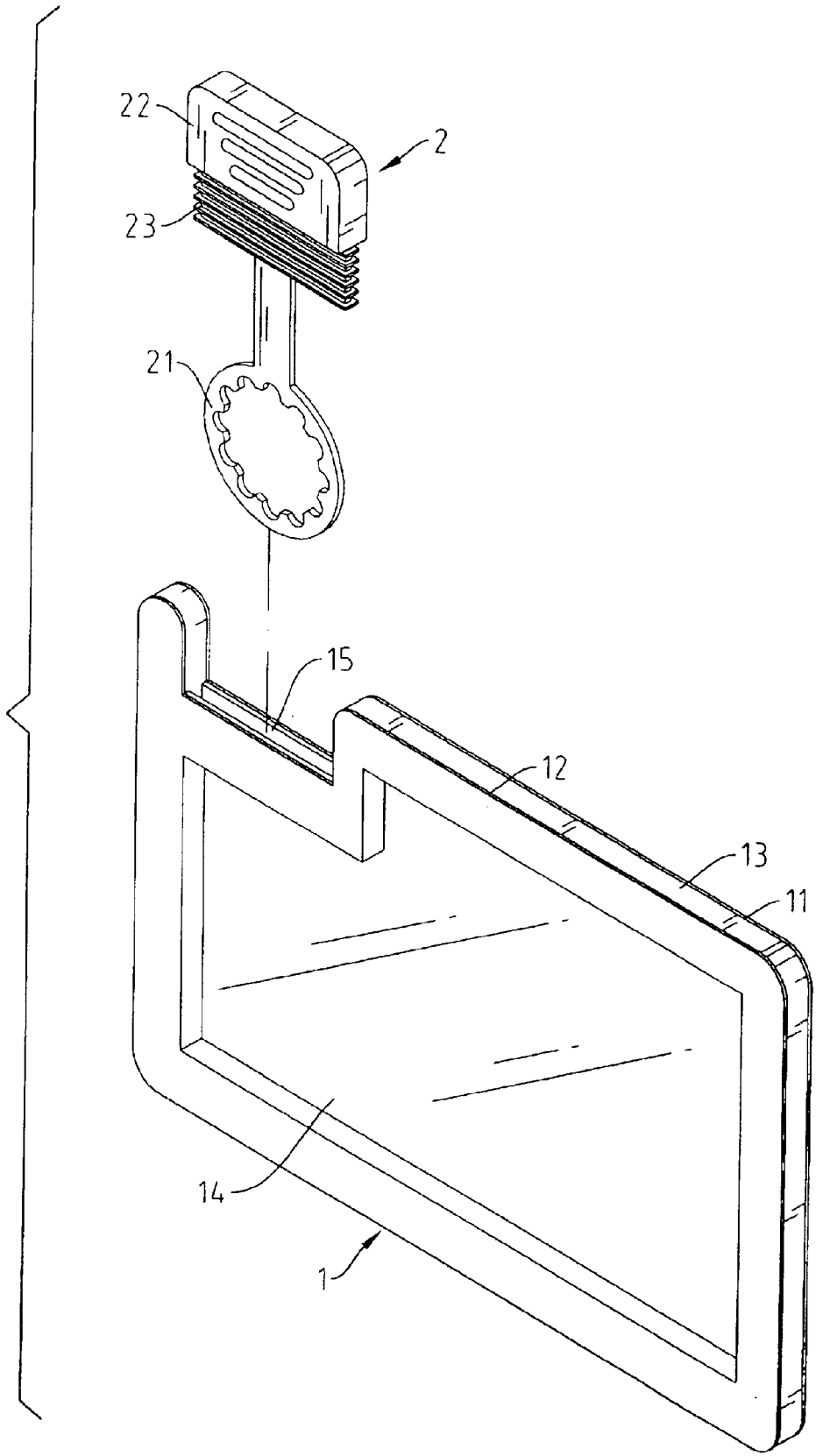
FIG. 2 is an exploded view of the thin-layer bubble blower shown in FIG. 1.
Figure 3:
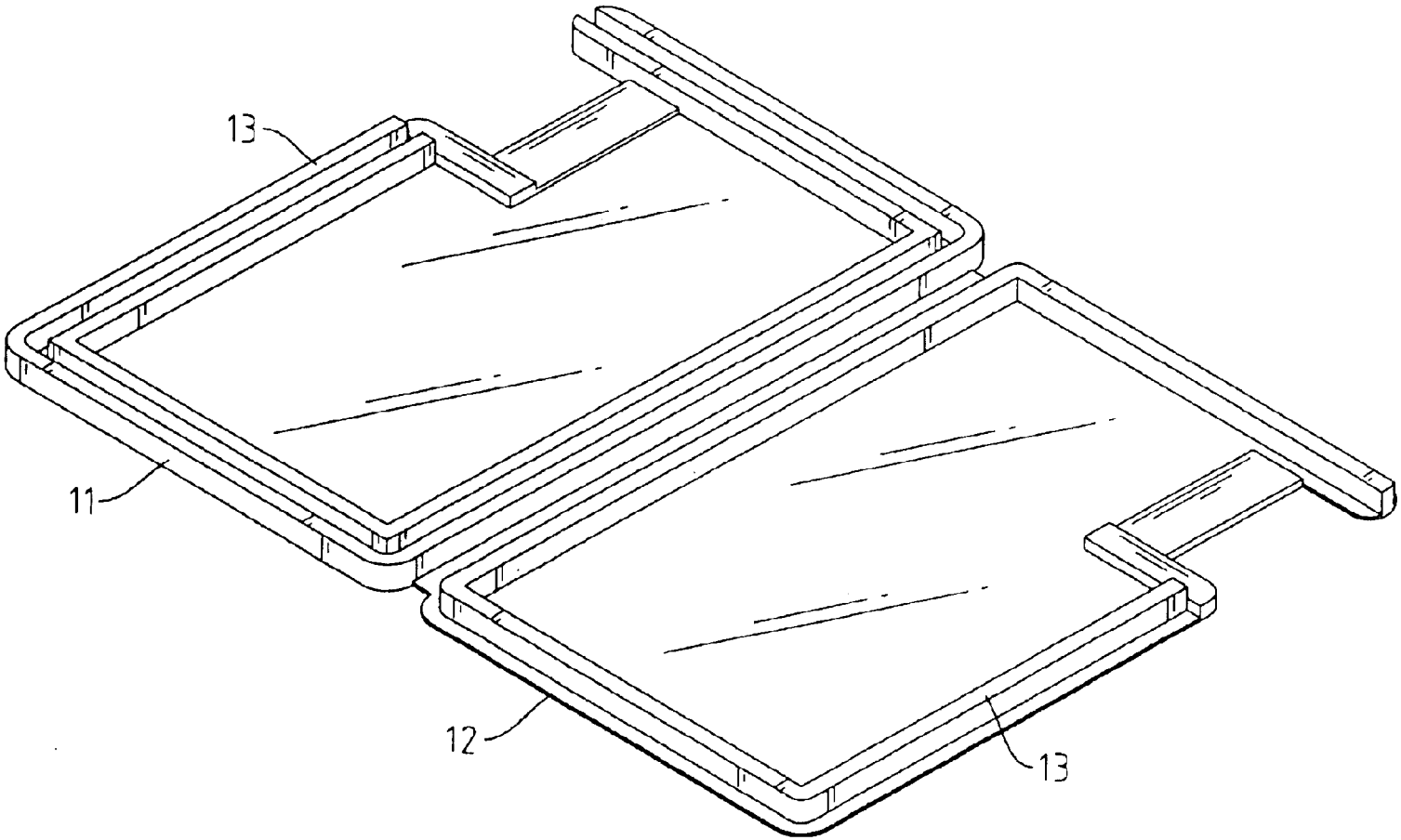
FIG. 3 is an extended-out view of the thin-layer container for the thin-layer bubble blower shown in FIG. 1.
Figure 6:
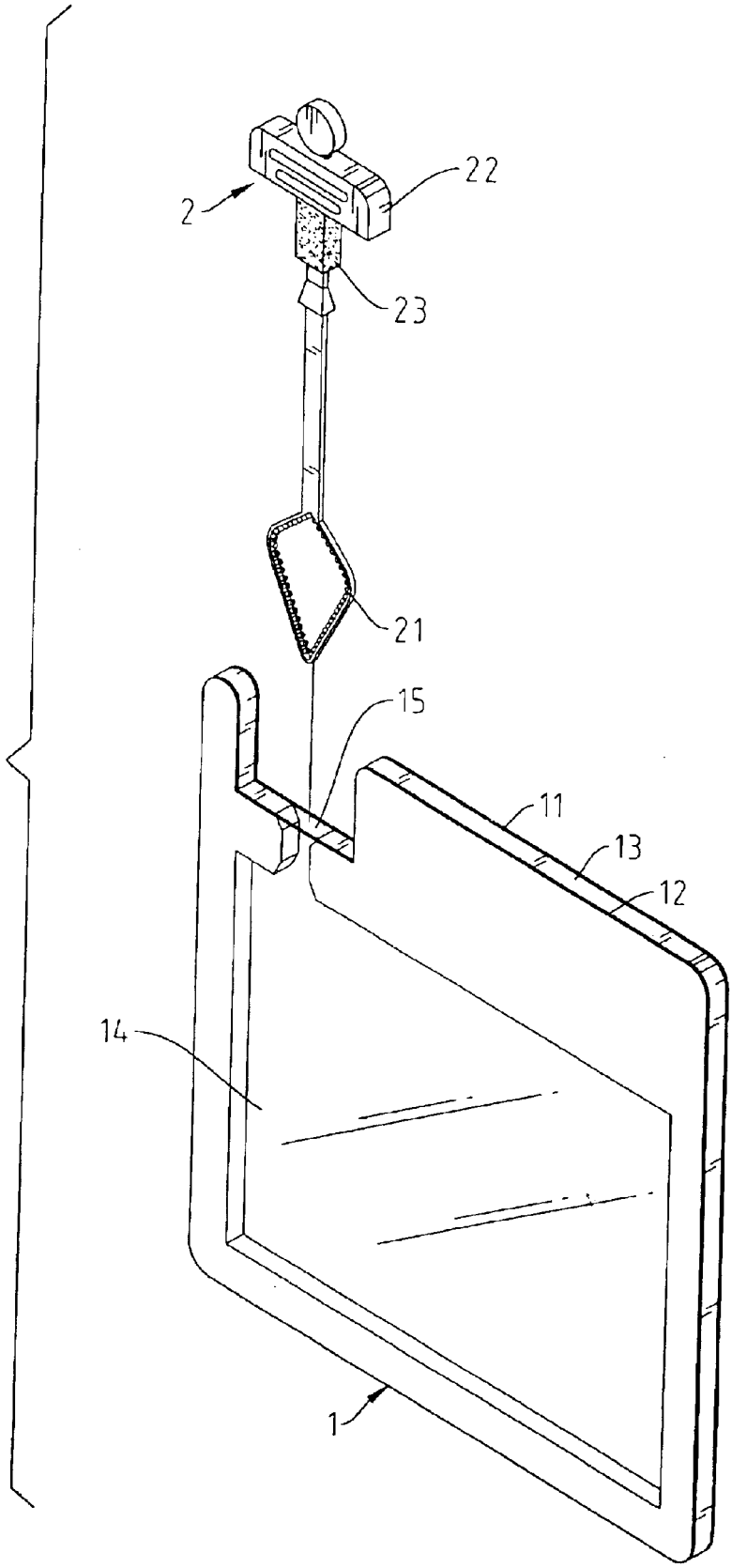
FIG. 6 is similar to FIG. 2 but showing an alternate form of the bubble-blowing element at the bubble-blowing bar.
Figure 7:
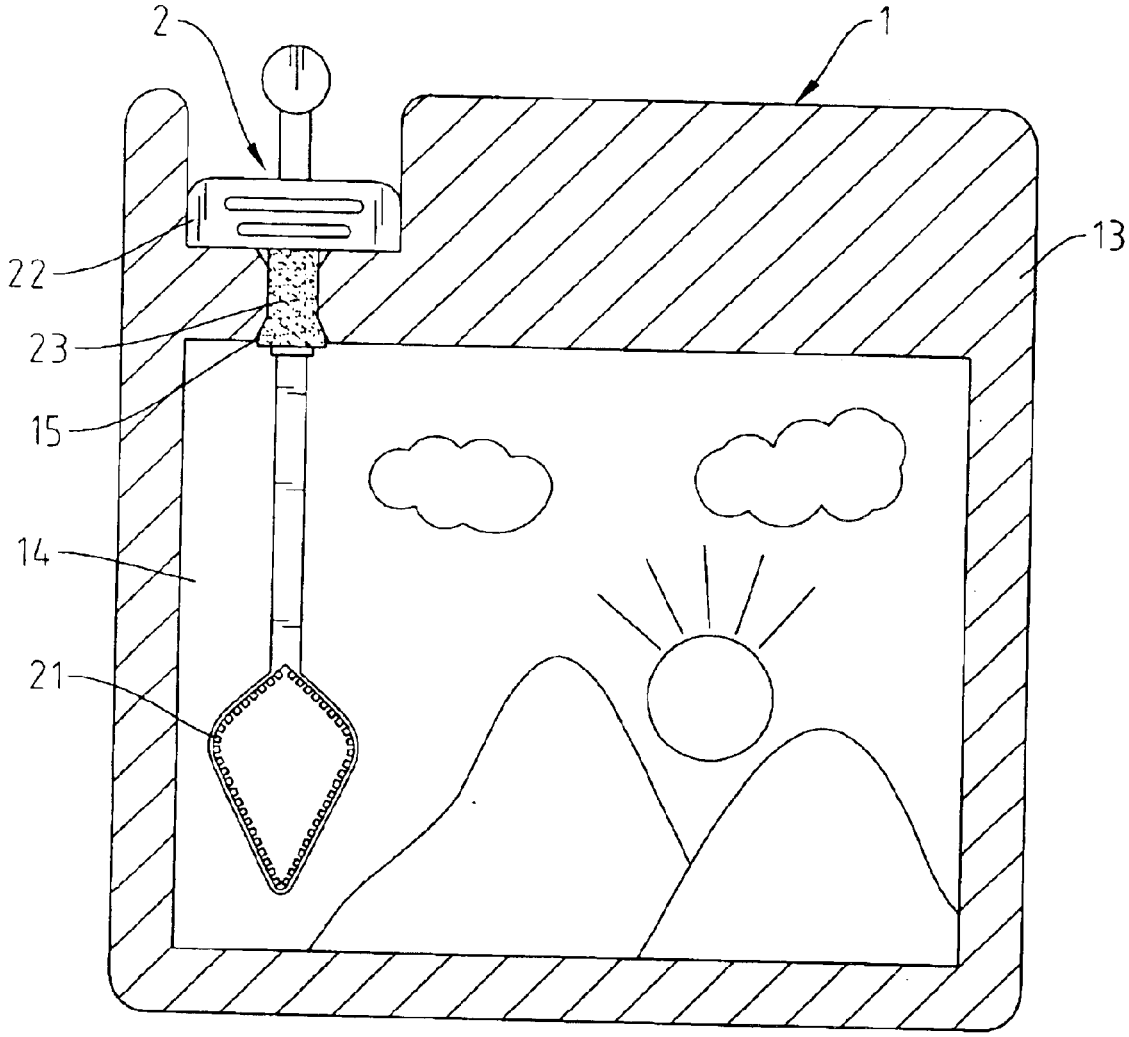
FIG. 7 is a sectional view of an alternate form of the thin-layer bubble blower according to the present invention.

The flat bubble-blowing bar 2 comprises a handle 22, a bubble-blowing element 21, and a rubber stopper 23 fixedly fastened to the handle 22 and spaced from the bubble-blowing element 21 at a distance for sealing the opening 15 of the thin-layer container 1. The bubble-blowing element 21 can be a rigid ring as shown in FIGS. 1 and 2, or a compressible coil as shown in FIGS. 6 and 7. The rubber stopper 23 can be formed of a stack of rubber plates as shown in FIGS. 1 and 2, or a solid rubber block (as shown in FIGS. 6 and 7).

Figure 8:
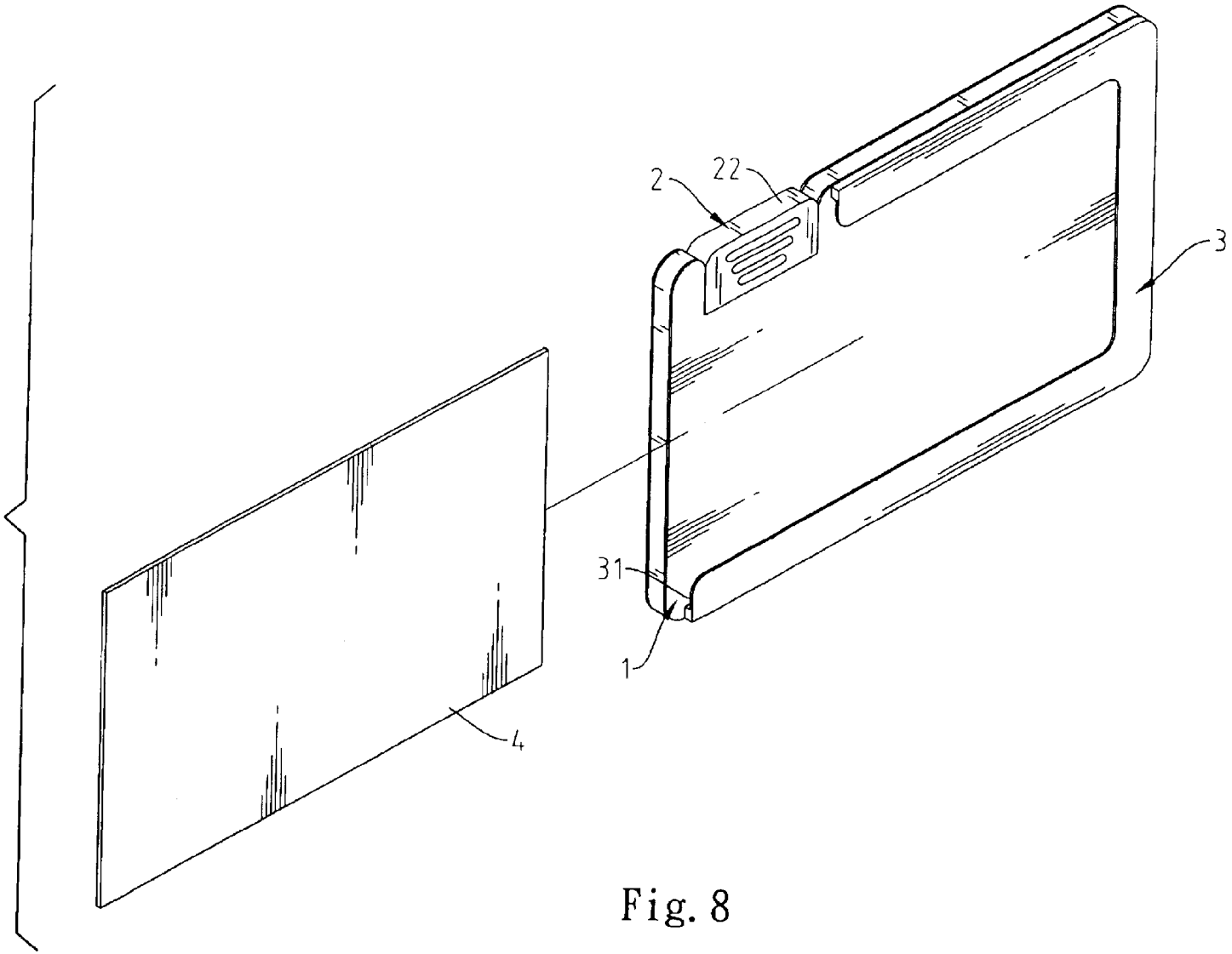
FIG. 8 shows an open frame disposed at one side of the thin-layer container for holding a card according to the present invention.

Referring to FIG. 8, the thin-layer container 1 can be made having an integrated open frame 3 at one side, which defines a coupling groove 31 adapted to hold a card or any of a variety of thin sheet devices 4.

Figure 9:
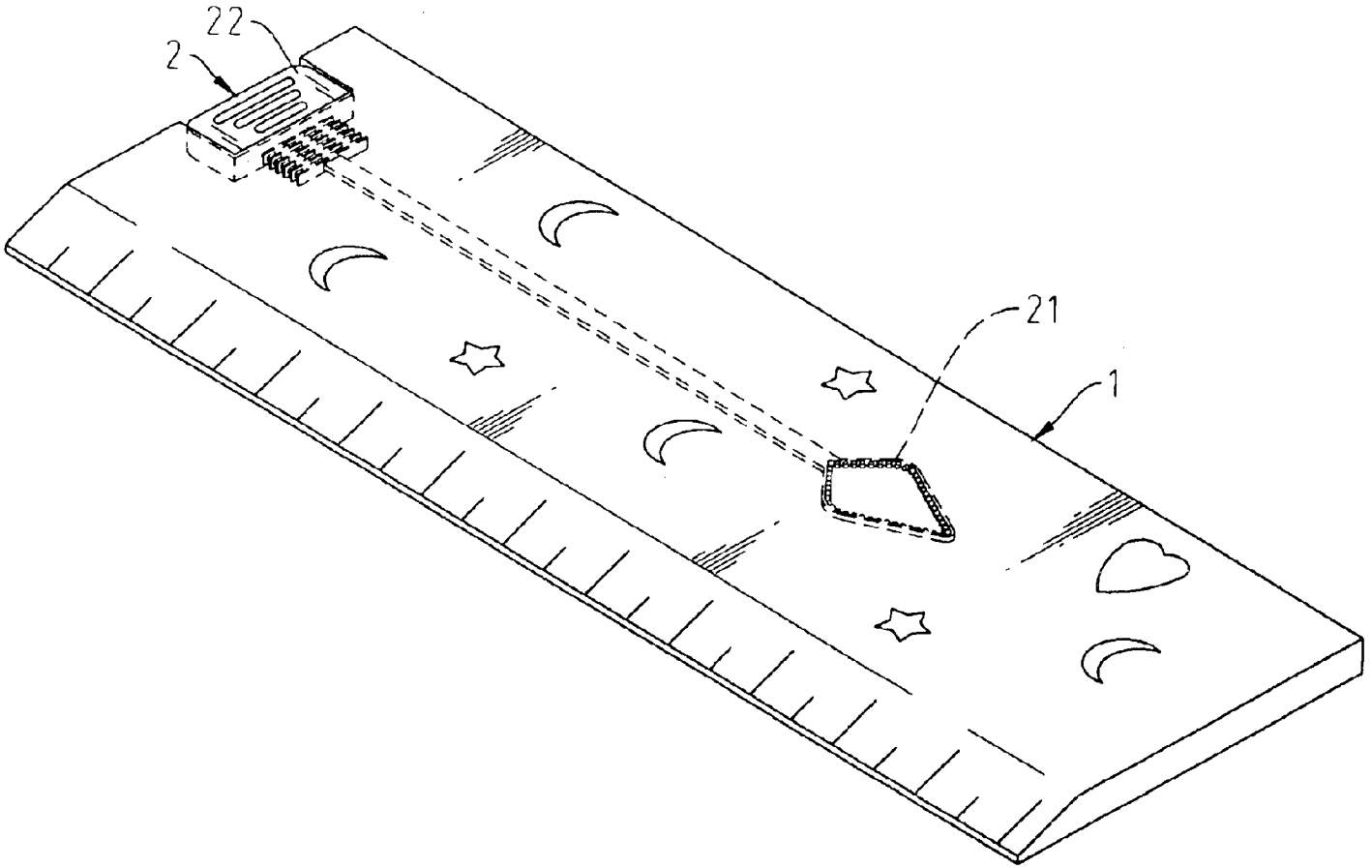
FIG. 9 is a perspective view of another alternate form of the present invention, showing the rule-like shape of the thin-layer container.
Figure 10:
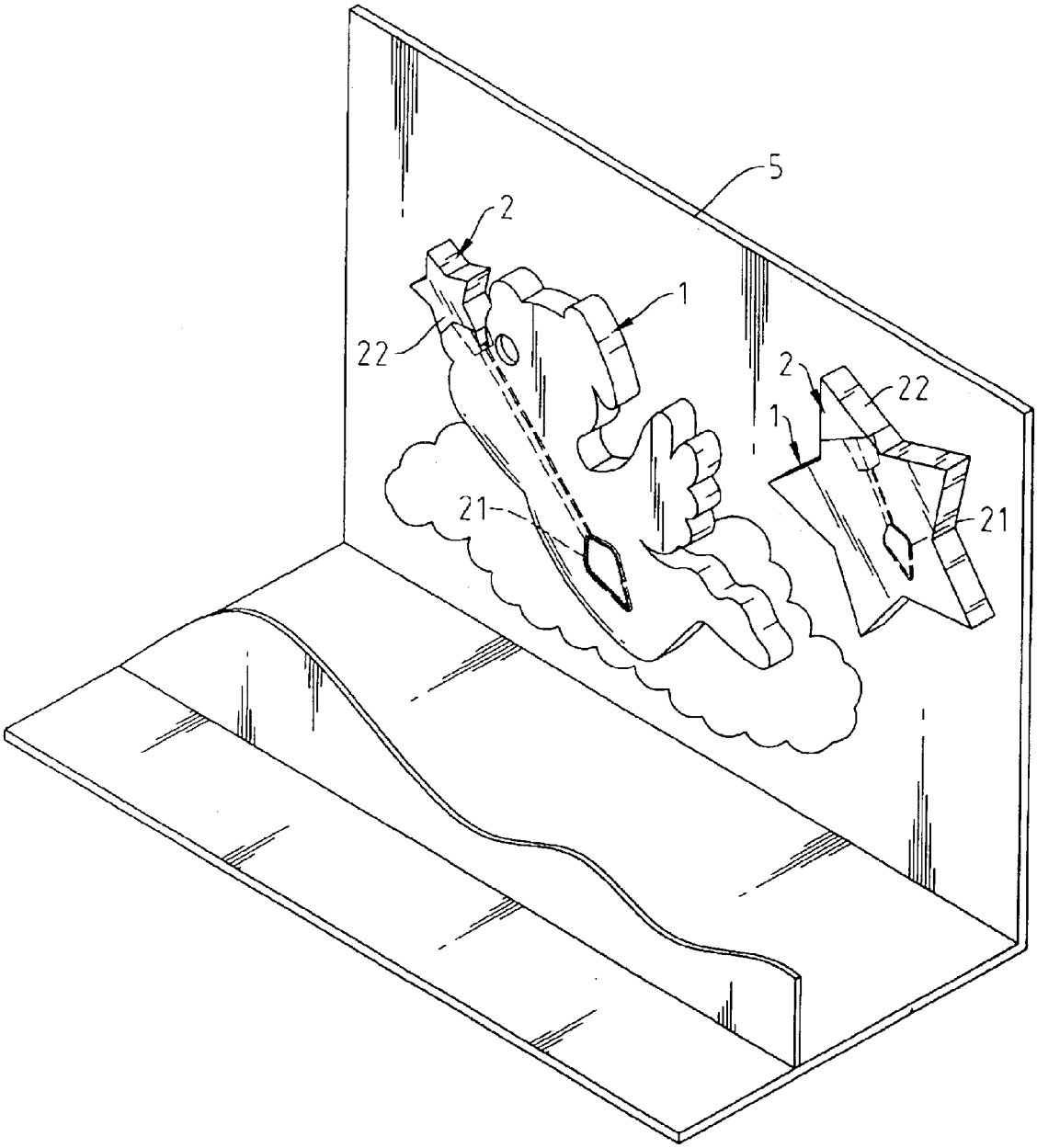
FIG. 10 shows still two different forms of the thin-layer bubble blowers fastened to a backboard according to the present invention.
Figure 11:
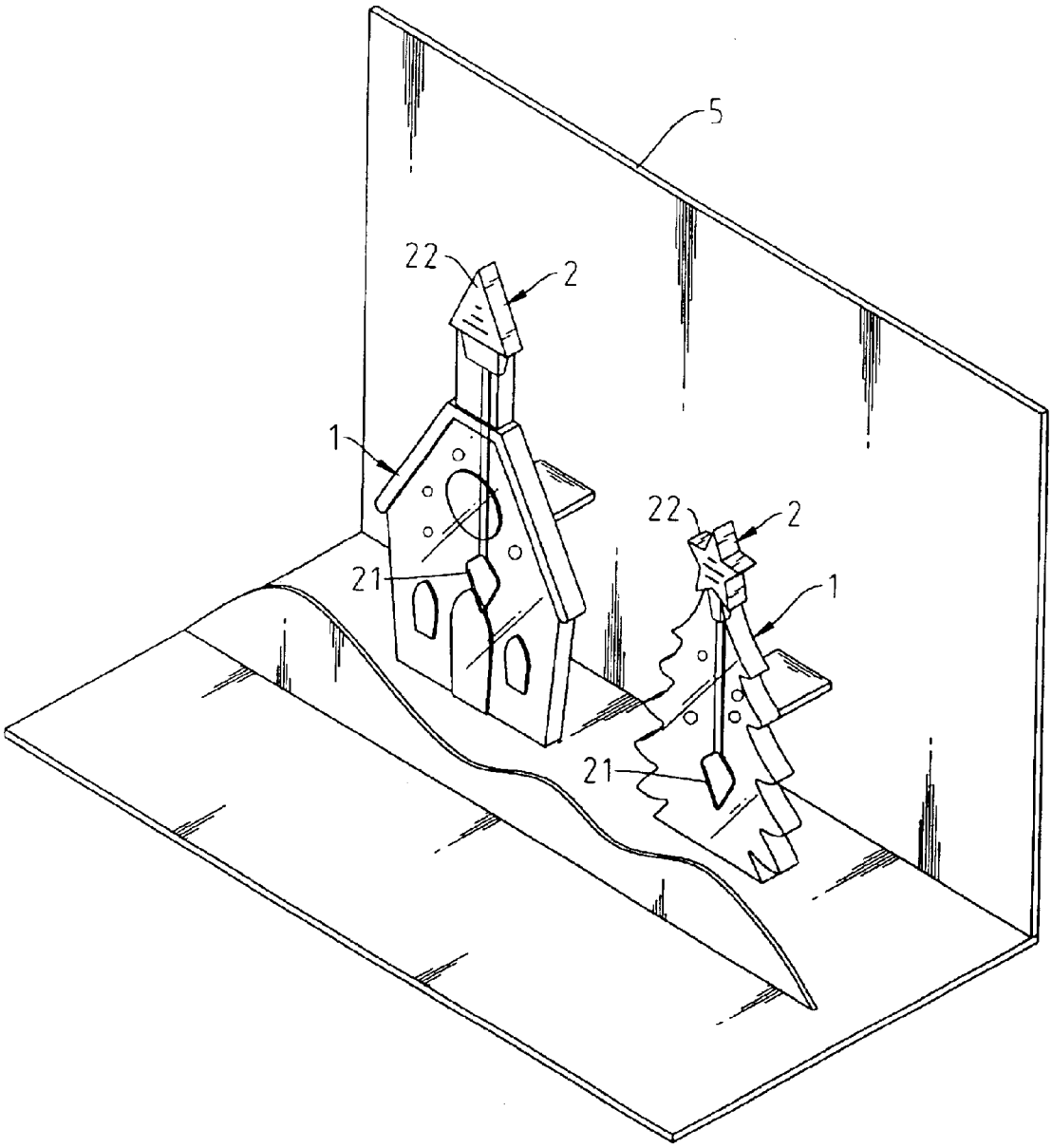
FIG. 11 shows still two different forms of the thin-layer bubble blowers fastened to a backboard according to the present invention.

Referring to FIG. 9, the thin-layer container 1 can be made in the form of a rule having marks for measuring distance.

Referring to FIGS. 10~13, the thin-layer container 1 can be made having any of a variety of shapes, and fastened to a backboard 5 for use as an ornament.

Figure 12:
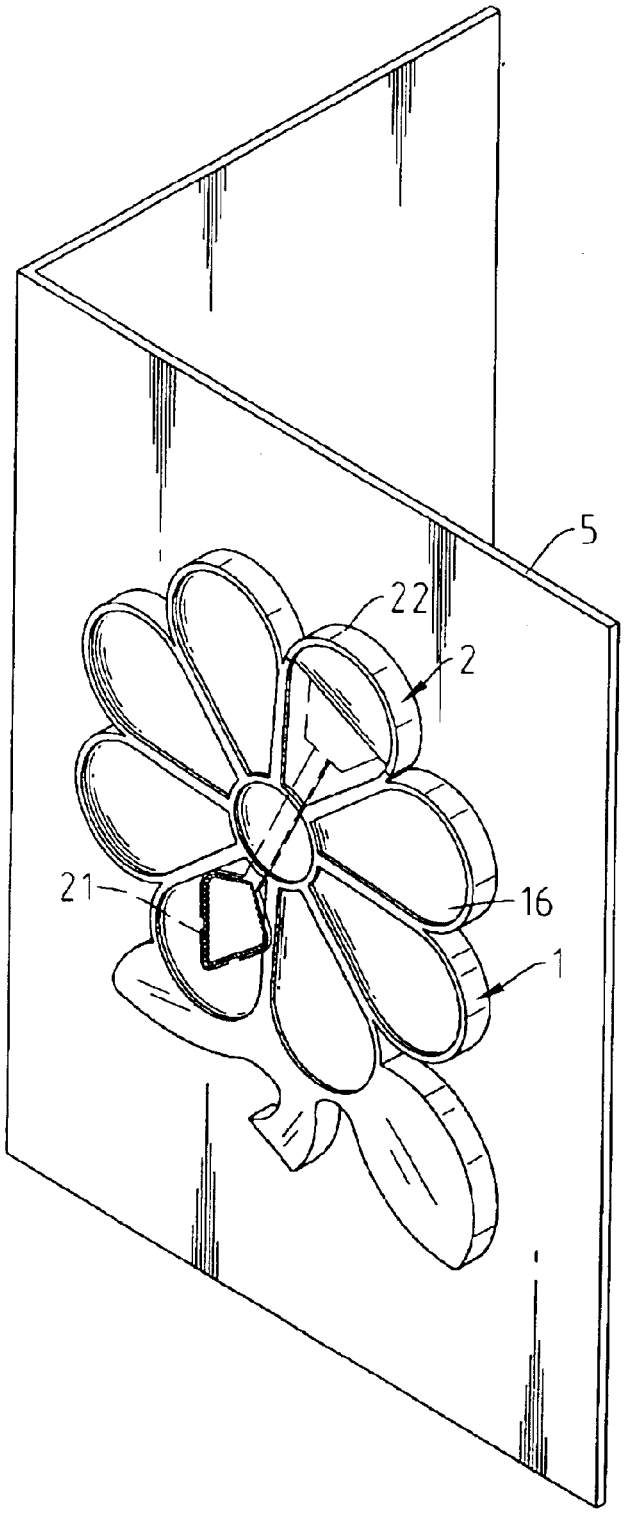
FIG. 12 shows still another different form of the thin-layer bubble blower fastened to a backboard according to the present invention.
Figure 13:
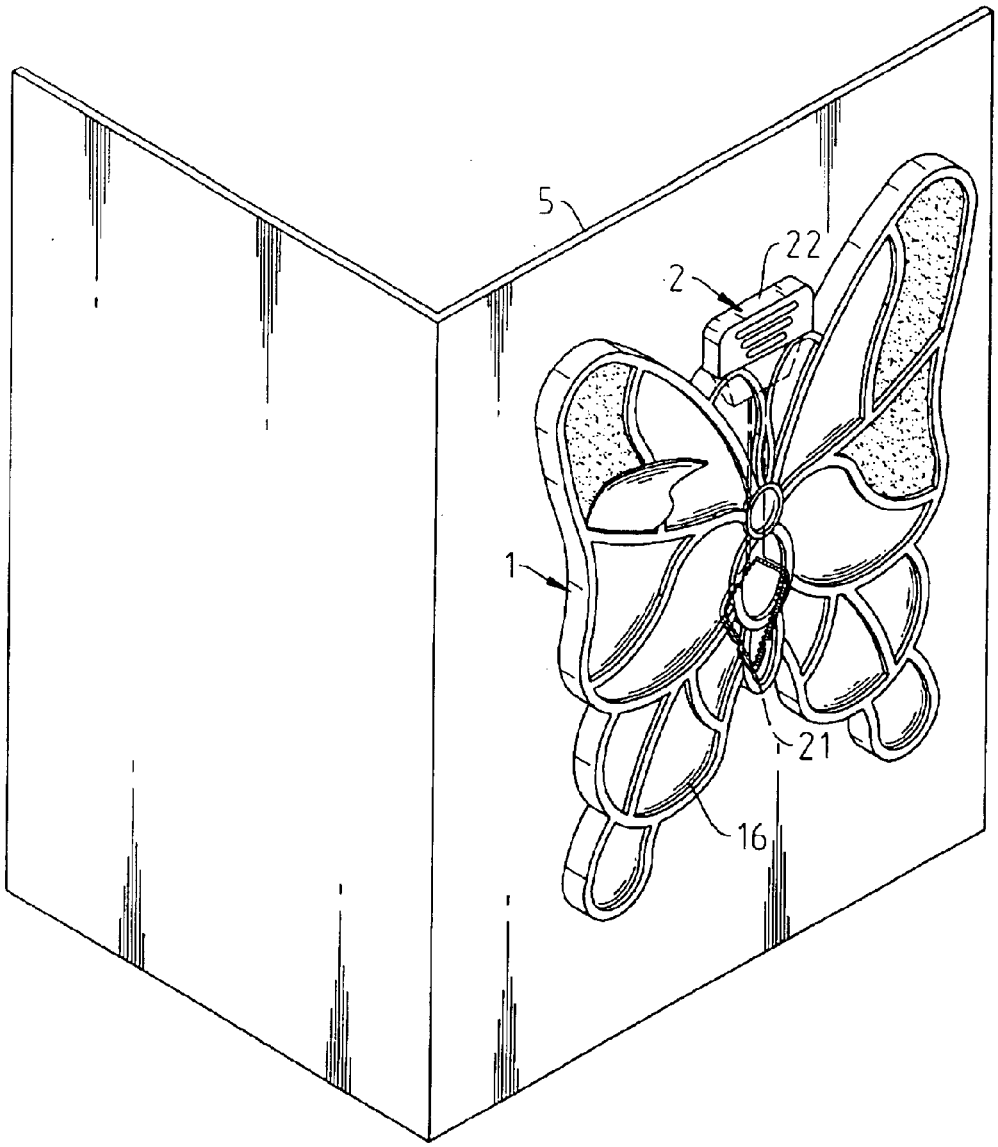
FIG. 13 shows still another different form of the thin-layer bubble blower fastened to a backboard according to the present invention.

Referring to FIGS. 12 and 13, the thin-layer container 1 can be made having recessed portions 16 for use as a palette or the like.

Figure 14:
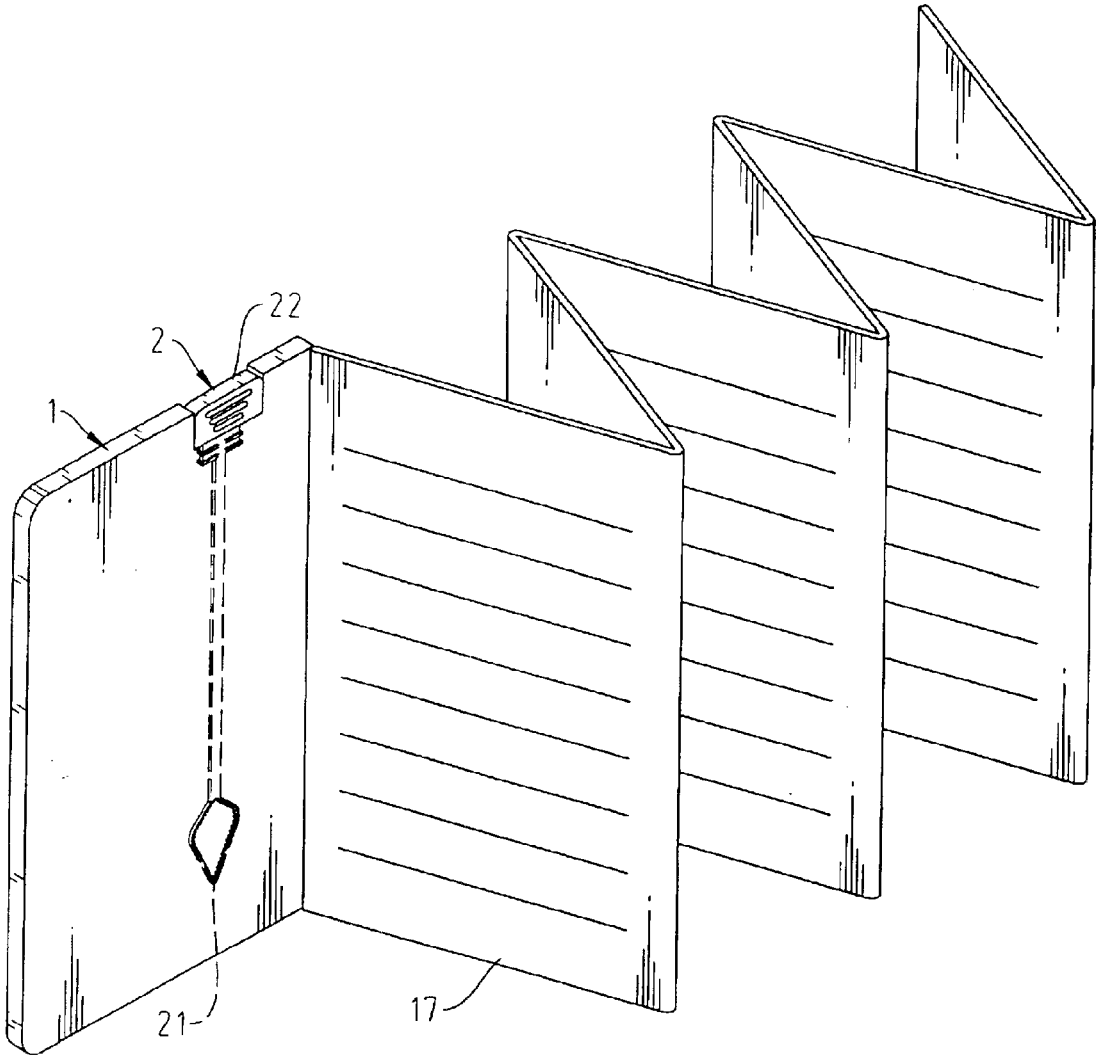
FIG. 14 shows the thin-layer container fastened to one end of a folding sheet member according to the present invention.

Referring to FIG. 14, the thin-layer container 1 can be fixedly fastened to one end of a folded sheet member 17.

Figure 15:
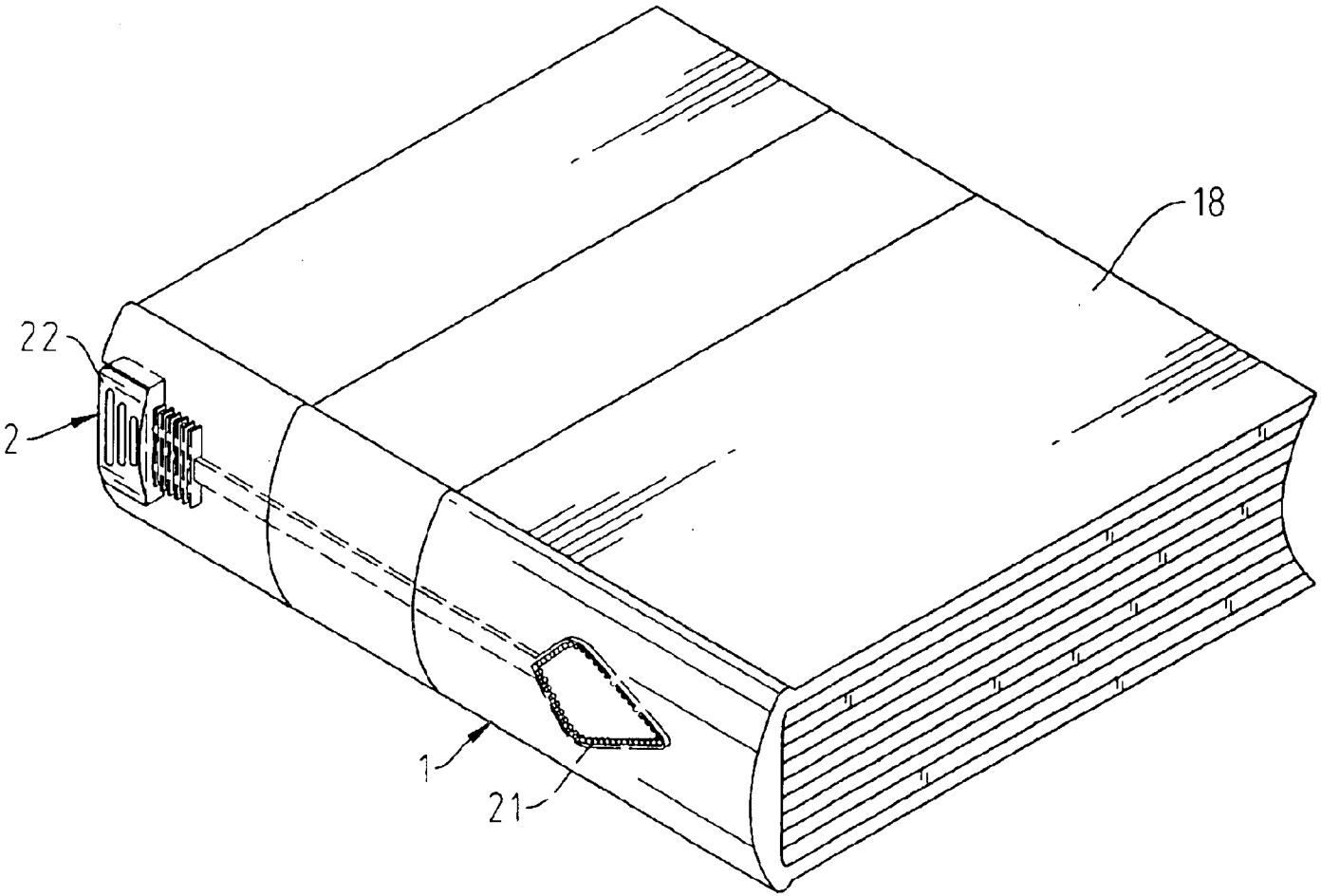
FIG. 15 shows the thin-layer container of the thin-layer bubble blower fixedly mounted with an ornament according to the present invention.

Referring to FIG. 15, the thin-layer container 1 can be fixedly mounted with an ornamental device, for example, an ornamental mini book 18.

Figure 16:
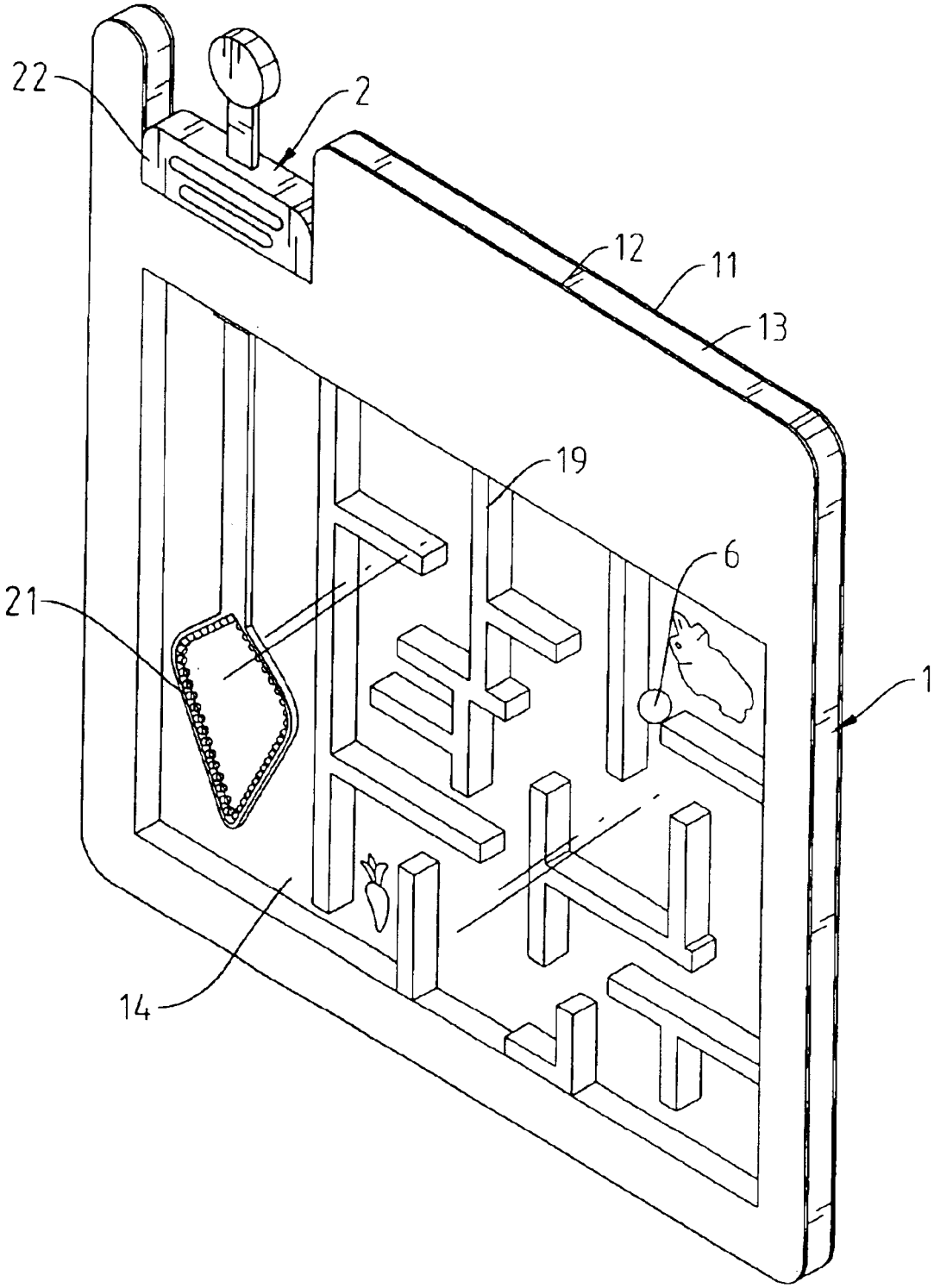
FIG. 16 shows a labyrinth formed in the flat liquid chamber of the thin-layer container according to the present invention.

Referring to FIG. 16, the thin-layer container 1 may be made having ribs 19 disposed inside the flat liquid chamber 14 to form a labyrinth, and floating devices 6 floating in bubble solution in the flat liquid chamber 14. According to this embodiment, the thin-layer container 1 is made of transparent material.

Figure 17:
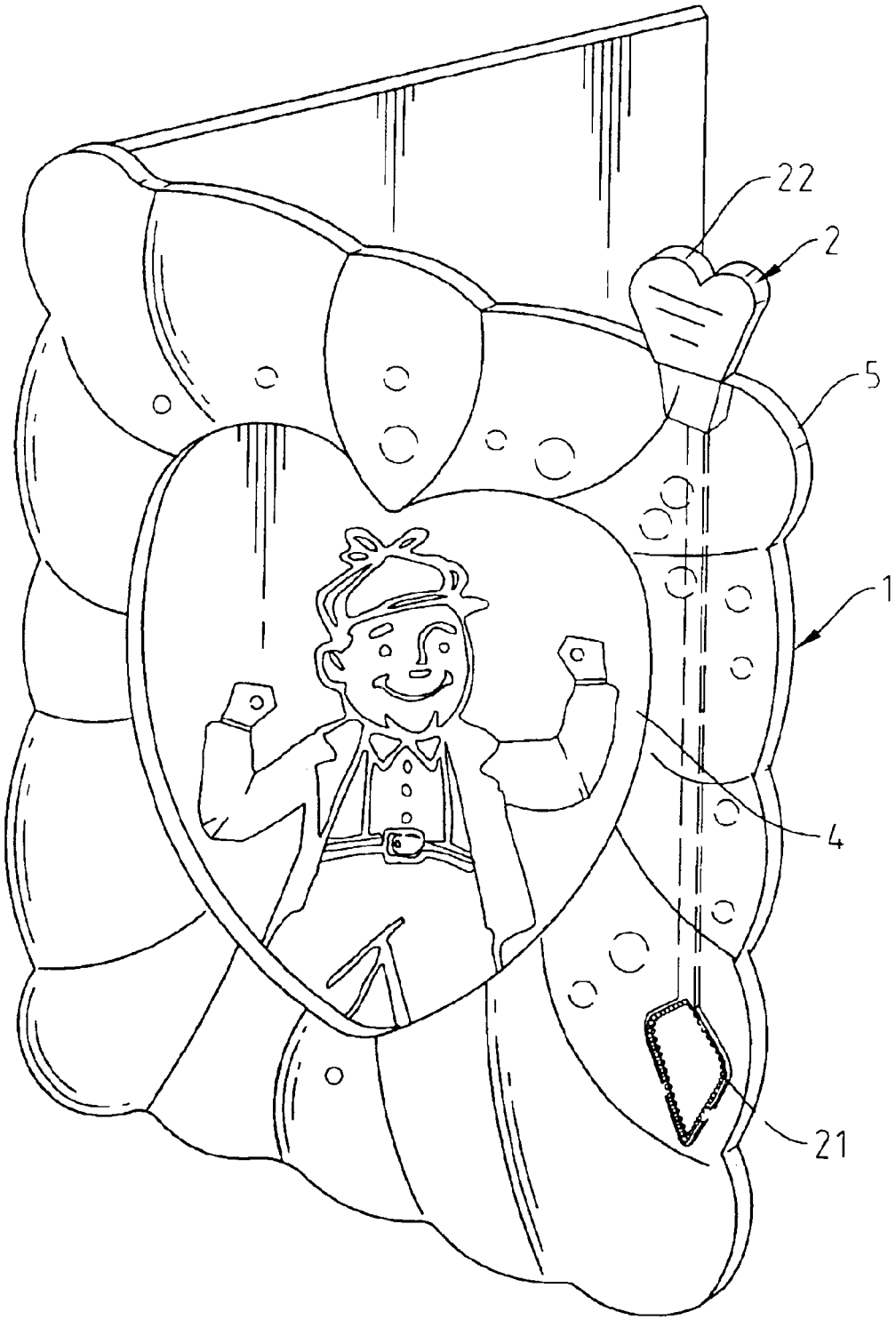
FIG. 17 shows a thin-layer bubble blower made by vacuum forming and integral with a backboard according to the present invention.
Figure 18:
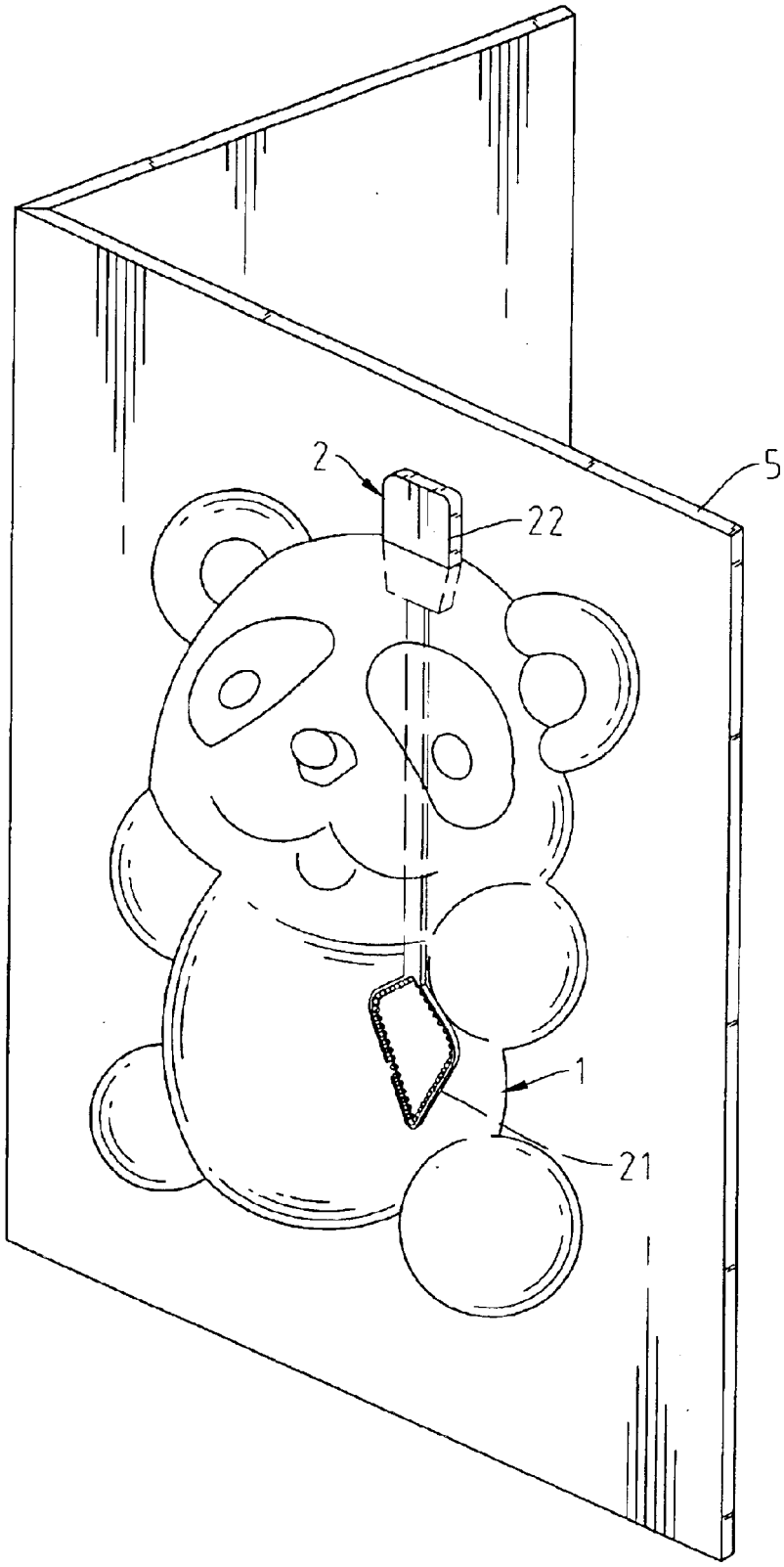
FIG. 18 shows an alternate form of the thin-layer bubble blower made by vacuum forming and integral with a backboard according to the present invention.
Figure 19:
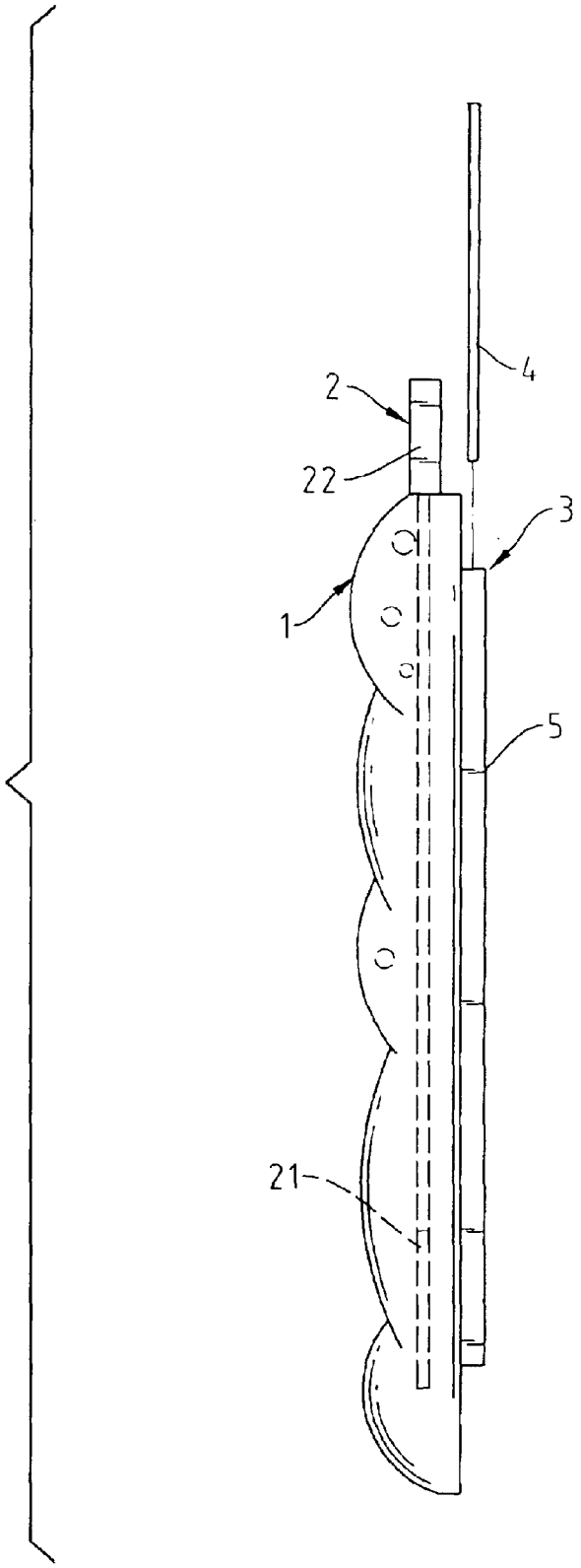
FIG. 19 shows an alternate form of the thin-layer bubble blower made by vacuum forming and integral with a backboard provided with an open frame for holding a card according to the present invention.

In the aforesaid embodiments, the thin-layer container 1 is comprised of two flat cover plates 11 and 12 joined together and defining a flat liquid chamber 14 and an opening 15. Alternatively, the thin-layer container 1 can be made by vacuum molding, and then fixedly fastened to a backboard 5, which has an open frame 3 for holding a card 4 (see FIGS. 17~19).

A prototype of thin-layer bubble blower has been constructed with the features of FIGS. 1~19. The thin-layer bubble blower functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A thin-layer bubble blower comprising:

a) a container having:

i) two flat cover plates connected together;

ii) a flat liquid chamber formed between the two flat cover plates and containing a bubble solution therein; and iii) an opening, wherein the container has a thickness between 2 and 6 mm; and b) a bubble-blowing bar removably inserted into the flat liquid chamber through the opening for blowing the bubble solution into bubbles, wherein said container is shaped like a rule and has marks for measuring a distance.

2. A thin-layer bubble blower comprising:

a) a container having:

i) two flat cover plates connected together;

ii) a flat liquid chamber formed between the two flat cover plates and containing a bubble solution therein; and iii) an opening, wherein the container has a thickness between 2 and 6 mm; and b) a bubble-blowing bar removably inserted into the flat liquid chamber through the opening for blowing the bubble solution into bubbles, wherein said container has one side fixedly mounted with a folding sheet member.

3. A thin-layer bubble blower comprising:

a) a container having:

i) two flat cover plates connected together;

ii) a flat liquid chamber formed between the two flat cover plates and containing a bubble solution therein; and iii) an opening, wherein the container has a thickness between 2 and 6 mm; and b) a bubble-blowing bar removably inserted into the flat liquid chamber through the opening for blowing the bubble solution into bubbles, wherein said container further comprises a plurality of ribs located inside said flat liquid chamber and forming with said flat liquid chamber a labyrinth, and floating elements floating in said bubble solution inside said flat liquid chamber.

* * * * *